US007314253B2

(12) United States Patent
Tillessen et al.

(10) Patent No.: US 7,314,253 B2
(45) Date of Patent: Jan. 1, 2008

(54) PLOUGH FOR UNDERGROUND MINING

(75) Inventors: Uwe Tillessen, Kamen (DE); Norbert Hesse, Bochum (DE); Gerhard Siepenkort, Lünen (DE); Klaus Duhnke, Bochum (DE); Adam Klabisch, Dortmund (DE)

(73) Assignee: DBT GmbH, Lunen (DE)

( * ) Notice: Subject to any disclaimer, the term of this patent is extended or adjusted under 35 U.S.C. 154(b) by 0 days.

(21) Appl. No.: 11/030,677

(22) Filed: Jan. 6, 2005

(65) Prior Publication Data

US 2005/0151412 A1 Jul. 14, 2005

(30) Foreign Application Priority Data

Jan. 14, 2004 (DE) ..... 20 2004 000 516 U

(51) Int. Cl.
*E21C 27/34* (2006.01)

(52) U.S. Cl. ..... 299/34.1; 299/42

(58) Field of Classification Search ..... 299/42–44, 299/34.01, 34.04, 34.09, 34.1, 34.11, 34.12
See application file for complete search history.

(56) References Cited

U.S. PATENT DOCUMENTS 4,583,785 A * 4/1986 Breuer et al. ..... 299/34.09
6,000,117 A * 12/1999 Bain ..... 29/458

FOREIGN PATENT DOCUMENTS

DE 19637226 A1 * 3/1998
RU 2100600 C1 * 12/1997

* cited by examiner

*Primary Examiner*—Sunil Singh
(74) *Attorney, Agent, or Firm*—Fay Sharpe LLP

(57) ABSTRACT

A coal plough for underground mining has a plough body that is guided along a plough guide. The plough body has at least one foot piece which receives a sliding skid. The sliding skid has at least one contact surface formed on its underside, which surface slides on a rail of the plough guide when the sliding skid is in its operating position. The sliding skid has first and second wear inlays on an underside which is arranged in the area of the highest load. The sliding skid can withstand high mechanical loads for a longer period of use.

8 Claims, 2 Drawing Sheets

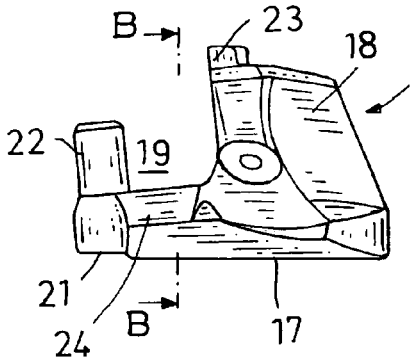
Fig.2
Fig.3
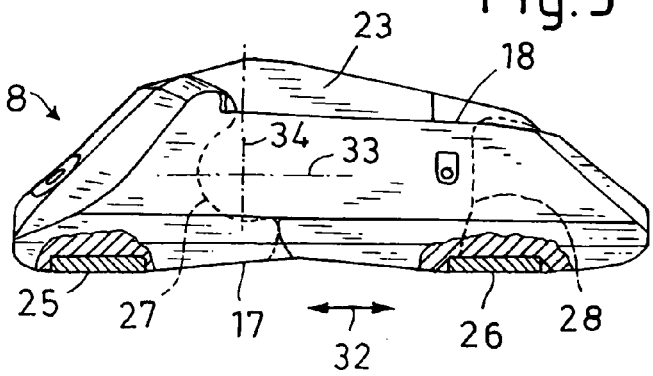
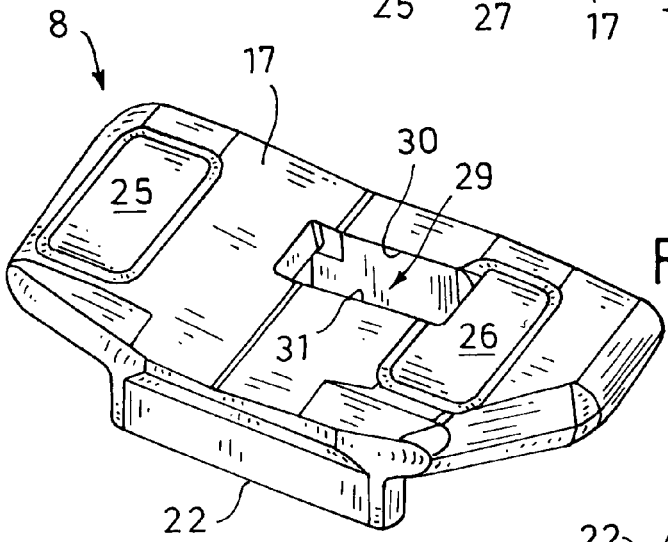
Fig.5
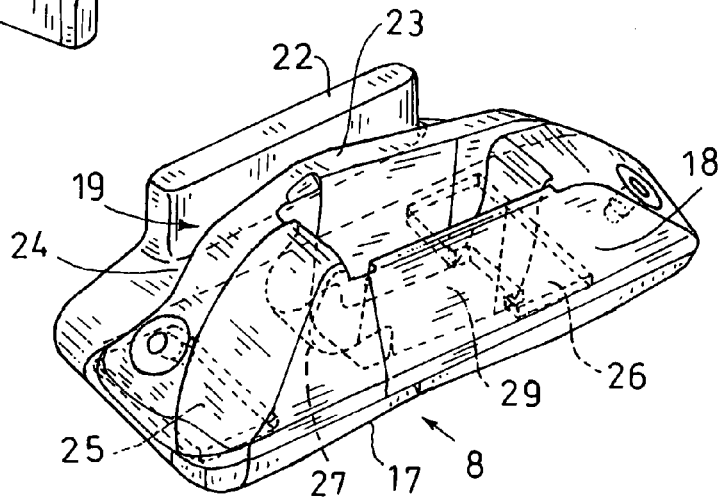
Fig.4

PLOUGH FOR UNDERGROUND MINING

FIELD OF INVENTION

The invention relates to a plough for underground mining, more specifically to a coal plough, with a plough body that is guided along a plough guide, wherein the plough body has at least one foot piece which receives a sliding skid having at least one contact surface formed on its underside that slides on a rail of the plough guide when the sliding skid is in its operating position.

BACKGROUND

Such a plough with a sliding skid is known, for example, from U.S. Pat. No. 4,583,785 (Breuer et.al). The known plough, with its plough body equipped with cutting tools, is guided along a plough guide and is connected by one foot piece each at both of its two ends to an exchangeable sliding skid. Here, each sliding skid has a guide shoe in which the foot piece is supported.

When the plough is in operation, the sliding skids slide with a sliding surface provided on their underside on a rail of the plough guide. The sliding skids are subjected to an especially high rate of abrasion/wear due to the weight of the plough and the high forces that must be transmitted from the sliding skids onto the rail during operation of the plough. For this reason, the sliding skids are releasably attached to the plough body so that worn sliding skids can be simply and rapidly replaced.

However, the replacement of worn sliding skids is associated with comparatively large amounts of effort and high costs. The sliding skids as a whole are comparatively complex components and are expensive to produce. Their replacement can take a relatively long time and during this time the plough is out of commission, meaning that no coal can be extracted during this period.

SUMMARY OF INVENTION

The object of the invention is to create a plough of the type mentioned above with at least one sliding skid that does not only have a long operational life but that is also cheap to manufacture and utilise.

This object—among others—is achieved with the invention in that the sliding skid has at least one wear inlay on its underside, preferably in the area of the highest load. The sliding skid that is provided with the wear inlay can withstand the high mechanical loads for a longer period of use than hitherto-known runners. To this end, a more wear-resistant material which can even be more expensive than the base material of the sliding skid is used efficiently in a concentrated manner in the area of the highest load. In this way, the sliding skid preferably only slides on the wear inlay or on the wear inlays.

In a preferred embodiment of the invention, the sliding skid is configured as a hinged runner that can be connected in a swivelling manner with the foot piece in a plane perpendicular to the seam, whereas the swivelling axis extends at a right angle to two oppositely directed sliding directions of the sliding skid, and whereas at each of the sliding skids one wear inlay is provided in front of the swivelling axis and one wear inlay is provided behind the swivelling axis. The force that acts upon the sliding skid is then distributed onto the two wear inlays wherein the ratio of partial forces that are to be absorbed corresponds to the inverse ratio of the effective levers of the wear inlays about the swivelling axis. Here, the effective levers correspond, in good approximation, to the distances between the centre of gravity of the surfaces of the two sliding surfaces of the wear inlays and the swivelling axis in the sliding direction.

It is possible that the distance from one wear inlay to the swivelling axis is approximately twice as large as the distance from the other wear inlay to the swivelling axis. This means that the one wear inlay must absorb a load that is twice as large as that absorbed by the other wear inlay. It can therefore be expedient that the wear inlay that is disposed closer to the swivelling axis has a greater effective area and/or a higher resistance to wear so that approximately uniform wear of the two wear inlays is attained. If, on the other hand, the distance between one wear inlay and the swivelling axis is very small, this wear inlay would have to bear almost the entire load which would lead to a corresponding uneven wear of the wear inlay.

It is preferred that the distances from the two wear inlays to the swivelling axis are at least approximately equal. Such a configuration means that the two wear inlays are subjected to approximately equal loads and are therefore subjected to approximately the same rate of wear.

The wear inlay(s) can be sintered with hard metal whereby a high resistance to wear is attained. The individual wear inlay can also have hard metal pins that are cast in a matrix that is made, for example, from cast steel. In turn, this matrix can be supported by a base plate, preferably of a weldable material. The hard metal pins can be disposed in the wear inlay so that they extend transverse to the sliding direction of the sliding skid. Their circumferential contour can be configured so that they neither have nor form sharp edges, even when wearing, that could cause damage to the fixed rail.

It is preferred that the wear inlay is disposed on the underside of the sliding skid in a manner so as to be exchangeable. Attachment can be, for example, via a bolted connection. However, it is preferred that the wear inlay is soldered or welded to the underside of the sliding skid.

The wear inlay is expediently configured as a wear plate that is embedded in a suitable, preferably substantially rectangular recess on the underside of the sliding skid. Here, the wear plate can be flush with the underside or can project slightly.

In an advantageous development of the invention, the underside of the sliding skid is bulged outwards in at least a partial section, whereas this partial section accepts a wear inlay in such a way that essentially only this rests on the rail. In this way, it can be ensured that wear does not take place in an area of the sliding skid where no wear-resistant material is provided.

It is preferred that the sliding skid is provided with a hook attachment that includes a rising limb that is at a distance from the guide shoe and, together with the guide shoe, forms an approximately U-shaped holding fixture that is open in the upward direction for a downwardly directed guide bar of the plough guide. In use, the sliding skid is therefore also guided by the guide bar, which is enclosed by the limb and the guide shoe, in the lateral direction, i.e. transverse to the longitudinal direction of the rail.

The guide shoe preferably has a raised shoulder on its side facing the rising limb. Here, the height of the shoulder, based on a transverse web of the hook attachment that connects the rising limb and the guide shoe, can be greater than that of the limb. The raised shoulder offers a large contact surface for the guide bar, which reduces wear in this area. Wear inlays can also be provided on an inner side of the limb and/or on the surface of the shoulder facing the limb.

The guide shoe can have an insertion slot that is open in the upward direction into which the foot piece of the plough can be inserted, whereas a front-wall wall limitation of the insertion slot is formed as a socket, via which the sliding skid together with the correspondingly shaped foot piece of the plough forms a swivellable connection.

BRIEF DESCRIPTION OF DRAWINGS

Further features and advantages of the invention are presented in the following description and in the drawings, in which a preferred embodiment of the invention is explained in greater detail by means of an example. It shows:

FIG. 2 an enlarged elevation of a sliding skid of the plough according to FIG. 1;

FIG. 3 a side elevation of the sliding skid according to FIG. 2;

FIG. 4 an oblique, perspective elevation from above of the sliding skid, wherein covered lines or edges are represented by dashed lines; and FIG. 5 a perspective elevation of the sliding skid from below.

DETAILED DESCRIPTION

Figure 1:
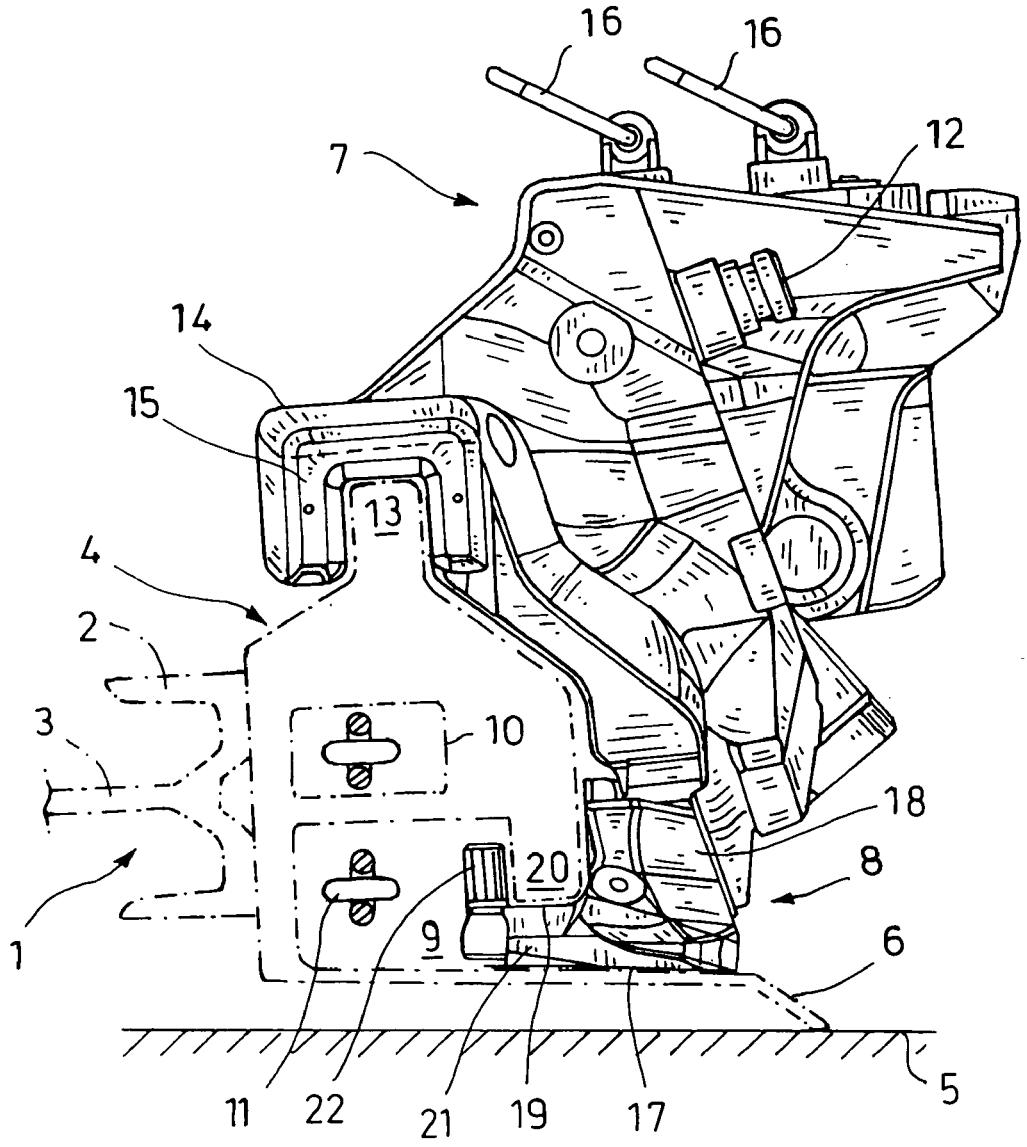
FIG. 1 a front elevational view of a plough, in accordance with the invention, with a plough guide and a plough body guided thereon, said plough body being supported on sliding skids.

FIG. 1 shows a face conveyor 1 laid out before a working or coal face (not illustrated), of which conveyor only a working face sided profile 2 and a conveyor base 3 are shown. A plough guide 4 is attached to the side profile 2 of the face conveyor 1 on the side of the working face, here schematically shown only in outline. The plough guide 4, like the face conveyor 1, comprises individual sections that can be angled slightly against one another in the horizontal and vertical plane. The basic structure of such a plough system is known and need not be described here in detail.

The plough guide 4 has a lower rail 6, on which a plough body 7 is supported on both of its two front-side ends by means of sliding skids, of which only one, namely the sliding skid 8, is visible in FIG. 1. Above the rail 6 the plough guide has a lower chain channel 9 and an upper chain channel 10, through which an endless plough chain 11 extends to drive the plough body 7 along the plough guide 4.

FIG. 1 shows a journal 12 formed on the plough body 7 to receive a cutting bar, not illustrated here, on which tools are disposed to dislodge the coal.

The plough guide 4 has an upwardly directed guide rail 13 at its apex. An upper guide pawl 14 of the plough body engages around the guide rail 13 like a hook. Between the guide pawl 14 and the guide rail 13 a U-shaped guide piece 15 is provided that is exposed to increased wear and is therefore releasably and exchangeably attached to the guide pawl 14. Crane lugs 16 are disposed on an upper side of the plough body 7, via which it can be lifted with suitable lifting means.

The sliding skid 8 slides with its underside 17 on the rail 6. It has a lateral guide shoe 18 into which a downward facing foot piece (covered, not illustrated), disposed on the plough body 7, engages. The weight pressure of the plough 7 and the forces that act upon the plough when it is in use are transmitted via the foot piece into the sliding skid 8 and thus onto the plough guide 4. The sliding skid 8 also forms a U-shaped holding fixture 19 that engages around a downwardly directed guide bar 20 on the plough guide from below, so that lateral forces, that is, forces transverse to the direction of movement of the plough body, can be transferred into the sliding skid 8.

FIG. 2 shows an enlarged view of the sliding skid 8. The U-shaped holding fixture 19 which provided for the guide bar 20 of the plough guide 7 (cf. FIG. 1) is limited on one side by a hook attachment 21, that forms a rising limb 22 of the holding fixture 19. The limb 22 is rounded on its front-side ends (cf. here especially FIG. 4). The other limb of the U-shaped holding fixture 19 is formed by a raised shoulder 23 of the guide shoe 18. The height of the raised shoulder 23, in relation to transverse web 24 that connects the shoulder 23 and the limb 22 of the U-shaped holding fixture 19, is greater than the height of the oppositely disposed limb 22. As can clearly be seen in FIG. 1, in the operating position of the sliding skid 8 the limb 22 engages in the lower chain channel 9 and, in conjunction with the shoulder 23, provides a lateral guide for the sliding skid 8.

FIG. 3 is a cross-section along the line B-B in FIG. 2. Here, two plate-shaped wear inlays 25, 26, that are embedded in the underside 17 that is bulged in partial areas, are shown in cross-section. The wear inlays comprise plates that are sintered with hard metal that are placed in correspondingly adapted recesses on the underside of the sliding skid 8 where they are soldered or attached by some other means. The wear inlays are especially durable due to their hard metal sintering, so the sliding skids that are fitted with the wear inlays can remain installed on the plough body for a substantially longer period of use before it is necessary to exchange them for a replacement runner. The old sliding skid can then easily be repaired with low effort in that only the wear inlays that are substantially subjected to the high rate of wear due to the weight and loosening pressure transmitted onto the plough guide by the plough body are replaced. Even if the cost of the wear inlay material is high in itself, the cost of repair of a sliding skid is lower than the cost of exchanging the runner for a completely new part, and repairs can generally be carried out several times.

The dashed lines in FIG. 3 show front-side wall limitations 27, 28 of an insertion slot 29 (see also FIG. 4) that is open in the downward and upward direction and is formed by the front-side wall limitations 27, 28 and by longitudinal-side walls 30, 31 of the guide shoe 18.

As can also be seen in FIG. 4, the front-side wall limitation 27 of the insertion slot 29 is configured as a one-piece, formed-on socket that is shaped like a half-shell, open in the direction of the inside of the slot, into which the foot piece that can be inserted into the insertion slot swivellably engages with a correspondingly configured joint end (not illustrated). The wall limitation 28 that is disposed opposite the wall limitation 27 is configured as a grooved contact surface that accepts a convex-rounded rear surface of the foot piece.

The swivelling axis of the swivel connection between the foot piece of the plough body 7 and the sliding skid 8 extends perpendicular to the two sliding directions of the sliding skid as indicated by the double-headed arrow 32 in FIG. 2. The swivelling axis extends through the intersection point of dashed lines 33, 34 in FIG. 3. The respective distances of the two wear inlays 25 and 26 from the swivelling axis are in a ratio of approximately 1:2. This means that based on a torque equilibrium about the swivelling axis, the wear inlay 25 disposed adjacent to the half-shell 27 must absorb a force that is approximately twice as high as that of the wear inlay 26. However, the different loading can be taken into account by configuring the size of the wear inlay with regard to its effective sliding area and its resistance to wear.

FIG. 5 shows a perspective elevation of the sliding skid 8 from below. The respective rectangular basic shape of the two plate-shaped wear inlays 25, 26 can clearly be seen, wherein the corners are rounded off. The wear inlays 25, 26 each extend over a large part of the total width of the underside 17.

The wear inlay 26 is indented slightly over approximately half its length on its side facing the insertion slot 29 so that insertion of the foot piece of the plough 7 is not hindered. Naturally, the wear inlay 26 could be disposed further away from the insertion slot 29. However, this would mean a greater distance from the swivelling axis, wherein the load on the other wear inlay 25 would be correspondingly greater.

The invention claimed is:

1. A coal plough for underground mining, said plough comprising a plough body that is adapted to be guided along an associated plough guide, said plough body comprising:

at least one foot piece;

a sliding skid received on said at least one foot piece, said sliding skid comprising at least one contact surface formed on its underside, said contact surface adapted for sliding on a rail of the associated plough guide when said sliding skid is in its operating position, said contact surface comprising first and second wear inlays on said underside of said sliding skid, wherein said sliding skid is configured as a hinged runner adapted to be connected in a swivelling manner with said at least one foot piece about a swivelling axis, said swivelling axis extending at a right angle to two oppositely directed sliding directions of said sliding skid, wherein said first and second wear inlays are located on opposite first and second sides of the swivelling axis so as to be in front of and behind said swivelling axis, respectively, wherein a first distance from said first wear inlay to said swivelling axis is approximately twice as large as a second distance from said second wear inlay to said swivelling axis;

wherein said sliding skid further comprises:

a lateral hook comprising a rising limb and forming an approximately U-shaped holding fixture for a guide bar on the associated plough guide; and, a raised shoulder spaced from said rising limb and cooperating with said rising limb to define said approximately U-shaped holding fixture, said raised shoulder greater in height as compared to said rising limb.

2. A plough according to claim 1, wherein said first and second wear inlays each comprise sintered hard metal.

3. A plough according to claim 1, wherein said first and second wear inlays are removably disposed on said underside of said sliding skid so as to be replaceable.

4. A plough according to claim 3, wherein said first and second wear inlays are bolted to said underside of said sliding skid.

5. A plough according to claim 1, wherein said first and second wear inlays are soldered or welded to said underside of said sliding skid.

6. A plough according to claim 1, wherein said first and second wear inlays comprise respective first and second wear plates, said first and second wear plates embedded in respective firsts and second recesses defined in said underside of said sliding skid.

7. A plough according to claim 1, wherein said underside of said sliding skid is bulged outwards at least in first and second sections where said first and second wear inlays are respectively located so that in said first and second bulged sections, respectively, essentially only said first and second wear inlays contact with said associated plough guide.

8. A plough according to claim 1, wherein said sliding skid comprises an open insertion slot into which said at least one foot piece is inserted, said insertion slot comprising a front-wall side wall limitation defining a socket, wherein said at least one foot piece and said socket are engageable to define a swivellable connection for movement of said sliding skid about said swivelling axis.

* * * * *